United States Patent [19]

Barlow et al.

[11] 4,020,588

[45] May 3, 1977

[54] ACTION ACCESSORY FOR USE WITH TRAVELLING TOY

[75] Inventors: Gordon A. Barlow, Skokie; Donald F. Nix, Hanover Park, both of Ill.

[73] Assignee: Marvin Glass & Associates, Chicago, Ill.

[22] Filed: Sept. 15, 1975

[21] Appl. No.: 613,296

[52] U.S. Cl. ..... 46/216; 46/108

[51] Int. Cl.[2] ..... A63H 11/10; A63H 15/00

[58] Field of Search ..... 46/108, 202, 201, 127, 46/116, 40, 216, 130, 134, 145

[56] References Cited

UNITED STATES PATENTS

| | | | |
|---|---|---|---|
| 362,238 | 5/1887 | Whitney | 46/216 X |
| 1,424,659 | 8/1922 | Linder | 46/216 X |
| 1,591,521 | 7/1926 | Esser | 46/201 X |
| 1,604,294 | 10/1926 | Marx | 46/40 |
| 2,034,325 | 3/1936 | Brady | 46/127 |
| 2,225,425 | 12/1940 | Welch | 46/216 |
| 2,346,221 | 4/1944 | Kimmel | 46/134 |
| 2,937,025 | 5/1960 | Bellak | 46/108 X |
| 3,067,540 | 12/1962 | Smith et al. | 46/40 |
| 3,293,793 | 12/1966 | Thomas | 46/116 X |

*Primary Examiner*—F. Barry Shay

[57] ABSTRACT

An action accessory for use with a model train, or the like. The accessory includes a first figure toy in the shape of a toy horse, and a second figure toy such as a cowboy for riding the horse and for removal therefrom. A frame is provided having an inclined ramp portion for rollably supporting the horse for movement on a path of travel generally parallel with the tracks of the model train. The frame includes a dismounting cam device at the lower end of the inclined ramp portion, which engages the foot of the cowboy figure on the side of the horse opposite the train tracks thereby causing the cowboy to dismount or alight from the horse directly onto a moving train, particularly a certain car thereof. A selectively operable lock is provided on the frame to maintain the horse and rider at the top of the ramp and for releasing the horse, causing him to travel down the ramp, in a timed relationship so that the rider successfully boards the moving train.

6 Claims, 5 Drawing Figures

ACTION ACCESSORY FOR USE WITH TRAVELLING TOY

BACKGROUND OF THE INVENTION

1. Field of the Invention

This invention relates to accessories for use with travelling toys or moving vehicles such as model trains or the like, and, in particular, to an accessory which permits a figure toy to board a moving train.

2. Description of the Prior Art

In the past, various types of accesory items have been provided for use with the increasingly popular model train sets, including signal lights, crossing guards, and loaders of various types. Some of these prior art devices are connected electrically with the train through its tracks to operate automatically upon the passage of a train. A familiar example of this type is the crossing gates which are lowered when a train approaches a crossing and raised after the train has completely passed the crossing. Other types have been provided which require the hobbyist or child who is using the train to participate in some manner, such as operating a loader.

SUMMARY OF THE INVENTION

An object of the present invention is to provide a new and improved train accesory item requiring participation, as well as timing and skill, on the part of the user.

In accordance with the object of the present invention, one embodiment is shown and described herein and includes a first figure toy, such as a horse, and a second figure toy, such as a rider, which move down an inclined ramp adjacent to and along the train tracks in an attempt to permit the rider to alight from the horse and to board a moving train. The accessory includes a selectively operable release mechanism at the top of the inclined ramp to maintain the figure toys thereat and to initiate their travel down the ramp. A dismounting cam device in the form of a fence rail is disposed at the lower end of the ramp and engages the riding figure toy, thus automatically dismounting or removing the rider from the horse for boarding a passing train. In order to successfully cause the second figure toy to board the train, the two figure toys must be released from their position at the top of the inclined plane in a timed relationship with the travel of a train past the accessory.

Other objects, features and advantages of the invention will be apparent from the following detailed description taken in connection with the accompanying drawings.

DESCRIPTION OF THE PREFERRED EMBODIMENT

Figures 1, 2, 3, 4, 5:
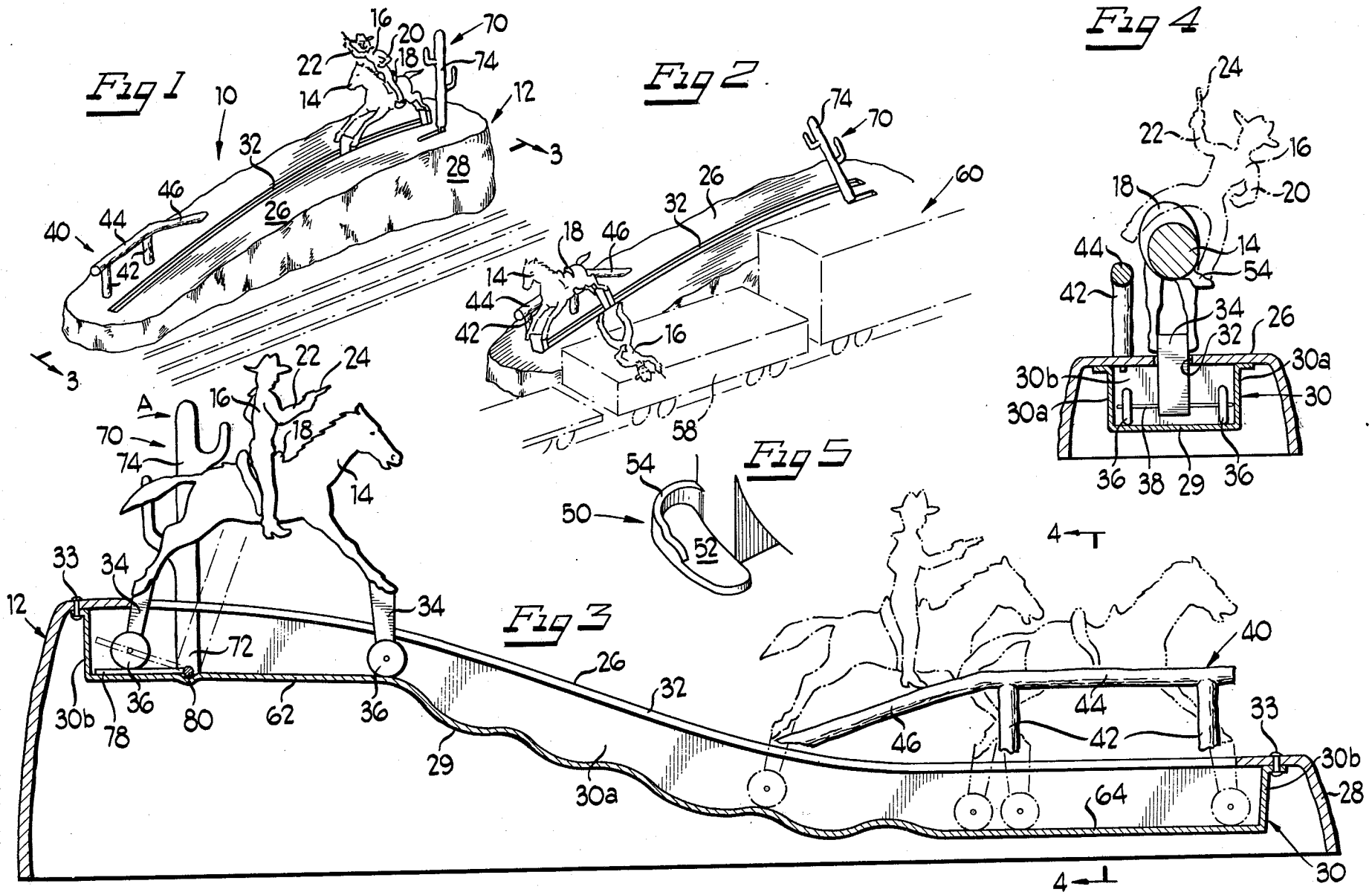
FIG. 1 is a perspective view of a train accessory embodying the concepts of the present invention, with the horse and rider figure toys at the top of the ramp.
FIG. 2 is a perspective view, similar to FIG. 1, showing the respective portions of the figure toys after the rider has boarded the train.
FIG. 3 is a sequential, generally vertical section, on an enlarged scale, representing the figure toy shown in FIG. 1 by solid lines and two positions approximating the removal of the rider as represented by phantom lines, taken generally along line 3—3 of FIG. 1.
FIG. 4 is a vertical section taken generally along line 4—4 of FIG. 3.
FIG. 5 is a rear perspective view, on an enlarged scale, of the left stirrup of the saddle of the horse figure toy.

Referring to FIG. 1, the present invention, generally designated 10, includes a frame, generally designated 2, a first figure toy in the form of a horse 14, and a second figure toy in the form of a rider or cowboy 16. The cowboy 16 is removably mounted to a saddle 18 provided for the horse 14. One arm 20 of the rider is held in a cocked position such as would be normal for a person holding the reins of a horse, while the other arm 22 is extended generally upwardly brandishing a gun 24 such as is familiar with train robbers of yesteryear.

Referring to FIG. 3, the frame 12 includes a generally inclined upper surface or top plateau 26 which is supported by a depending circumscribing flange 28. Preferably, the flange 28 has a generally rough contour to give the frame 12 the appearance of a small foothill. A generally inclined undulated ramp 29 (FIG. 3) defines a path of travel for the figure toy 14 and is mounted below the top 26 of the frame. The undulated ramp 29 comprises the bottom of a U-channel, generally designated 30, which is mounted directly below a slot 32 formed in the top 26 of the frame 12 by means of rivets or bolts 33 (FIG. 3). The U-shaped channel 30 has depending side walls **30*a* and end walls 30*b*. The front and rear legs of the horse 14 are secured to a pair of downwardly directed support posts 34 which extend through the slot 32. The support 34 each are supported by a pair of wheels 36 (FIG. 4) mounted near the outward end of an axle 38 which extends through an appropriate aperture in the bottom end of the posts 34. Thus, the figure toy horse 14 can travel down the undulated ramp 29** to the end thereof (the right in FIG. 3) and the undulations of the ramp impart vertical movement to the horse and rider in a galloping fashion.

Dismounting cam means, generally designated 40, is provided on the frame 12 to cause the figure toy cowboy 16 to dismount or alight from the horse. The dismounting cam means 40 comprises a fence rail, including a pair of upstanding fence posts 42 mounted in the top 26 of the frame and a horizontal fence rail 44 which is connected to an inclined cam rail 46. The inclined cam rail 46 slopes downwardly foot the opposite direction of the path of travel of the horse and rider down the undulated ramp 29. The rider 16 is mounted in the saddle 18 which is provided with only one stirrup, generally designated 50 (FIG. 5). The stirrup includes a foot support plate 2 which is partially circumscribed by a curved, generally upstanding flange 54 on the forward end thereof for engaging the front of the left foot of the rider. The stirrup 50 provides a fulcrum or pivot point for the rider so that as the horse travels down the undulated ramp 29, the right fooot of the cowboy engages the inclined cam rail 46 and, as the horse 13 continues to travel the rider is cammed upwardly and pivoted about the stirrup 50 as is shown in phantom in FIG. 4. By the time the cowboy's foot reaches the top of the inclined fence piece 46, the center of gravity thereof the rider would have reached an overcenter point such that the cowboy will fall off of the horse.

In its intended use, the horse and cowboy rider will be released from the toy of the inclined undulated ramp 29 in a timed relationship so that the cowboy can board one of the cars 58 of a model train, generally designated 60, passing the accessory. The model train preferably would have a flat car, such as car 58, between two higher cars so that a greater degree of skill is required for a user to have the rider land on the flat car instead of against the sides of the higher cars.

Preferably, the uppermost end 62 and lowermost end 64 of the undulated ramp 29 (FIG. 3) contain a substantially elongated horizontal portion so that the horse will come to rest both at the top and the bottom of the ramp 30. A selectively operable release mechanism, generally designated 70 (FIGS. 1, 2 and 3), is provided to initiate the movement of the horse 14 down the path 30. The release means includes a generally L-shaped member 72 having an upstanding portion 74 formed to simulate a conventional cactus plant and a lower back plate portion 78 upon which the rear wheels 36 of the horse rest in the beginning position. The L-shaped member is pivotally mounted by an axle 80 to the upper end 62 of the channel 30 so that the plate 78 lies in a generally horizontal position when the cactus portion 74 is generally vertical. The plate 78 pivots to a slight forward angle when the cactus portion 74 is manually moved forward to initiate the travel of the horse 4 down the undulated ramp 29.

Thus, as a model train 60 approaches, the user of the accessory 10 will pivot the cactus 74 forwardly, in the direction of arrow A in FIG. 3, to cause the horse and cowboy rider to roll down the undulated ramp, which gives the impression of a trotting or galloping horse. If the user has correctly timed the release of the horse, the cowboy's right foot will engage the inclined cam rail 46 causing the cowboy figure toy to be pivoted about the stirrup 50 to board the train or a particular car thereof.

The foregoing detailed description has been given for clearnesss of understanding only and no unnecessary limitation should be understood therefrom as some modifications will be obvious to those skilled in the art.

We claim:

1. An accessory for use with a travelling toy, such as a model train, or the like, comprising:

a frame having an inclined vertically undulated ramp portion defining a path of travel;

a first figure toy in the form of a horse supportable by wheel means thereon for movement along said path of travel from the top toward the bottom of the inclined undulated ramp;

a second figure toy in the form of a rider removably mountable upon said first figure top;

dismounting means on the frame at a stationary position along said inclined undulated ramp for engaging the rider toy as the horse passes the dismounting means whereby placement of the accessory adjacent the path of travel of the travelling toy permits a user to start the movement of the horse figure toy and mounted rider figure toy to travel down the inclined undulated ramp in a timed relationship so that the dismounting means causes the rider figure toy to alight from the horse figure toy onto the passing travelling toy; and release means at the top of said inclined undulated ramp for engaging the horse figure toy to initiate movement thereof from a starting position down the inclined undulated ramp.

2. An accessory for use with a model train or similar travelling toy, comprising:

a frame having an inclined ramp portion defining a path of travel;

a first figure toy supportable on the frame for movement along the path of travel from the top toward the bottom of the inclined ramp;

a second figure toy removably mounted upon said first figure toy; and dismounting means on the frame at a position along said inclined ramp and engageable with the second figure toy as it passes the dismounting means whereby placement of the accessory adjacent the path of travel of the model train or similar travelling toy permits a user to start the movement of the first figure and mounted second figure toy to travel down the inclined ramp in a timed relationship so that the dismounting means causes the second figure toy to alight from the first figure toy onto the passing train or similar travelling toy wherein said first figure toy is in the form of a horse rollably supported by wheel means on the inclined ramp and said second figure toy is in the form of a rider removably mounted on the horse and the dismounting means includes a simulated fence mounted in a fixed position on said frame and includng a rail having a portion thereof inclined in a direction opposite that of the ramp to engage one foot of the rider to thereby cause the rider to dismount from the horse on the side thereof opposite the simulated fence rail.

3. An accessory for use with a travelling toy, such as a model train, or the like, comprising:

a frame having an inclined vertically undulated ramp portion defining a path of travel;

a first figure toy in the form of a horse supportable by wheel means thereon for movement along said path of travel from the top toward the bottom of the inclined undulated ramp;

a second figure toy in the form of a rider removably mounted upon said first figure toy;

dismounting means on the frame at a position along said inclined undulated ramp and engageable with the rider figure toy as it passes the dismounting means, said dismounting means being in the form of a fence mounted in the inclined fixed position along said frame and including a rail extending along the path of travel of the horse figure toy down the inclined undulated ramp, and including an inclined cam rail portion for engaging one foot of the rider figure toy and automatically progressively moving the rider figure toy off of the horse figure toy as one foot rides up the inclined cam rail portion whereby placement of the accessory adjacent the path of travel of the travelling toy permits a user to start the movement of the horse figure toy and mounted rider figure toy to travel down theinclined undulated ramp in a timed relationship so that the dismounting means causes the rider figure toy to alight from the horse figure toy onto the passing travelling toy; and release means at the top of said inclined undulated ramp for engaging the horse figure toy to initiate movement thereof from a starting position down the inclined undulated ramp.

4. An accessory for usewith a travelling toy such as a model train, or the like, comprising:

a frame having means defining a path of travel therealong;

a first figure toy supportable on the frame for movement along the path of travel;

means for moving said first figure toy along said path of travel;

a second figure toy removably mountable upon said first figure toy; and dismounting means on the frame at a stationary position along said path of travel for engaging the second figure toy as said first figure toy passes the dismounting means whereby placement of the accessory adjacent the path of travel of the travelling toy permits a user to start movement of the first figure toy and mounted second figure toy to travel along their path of travel in a timed relationship so that the dismounting means caused the second figure toy to be dislocated from the first figure toy onto the passing travelling toy, wherein said first figure toy is in the form of a horse rollably supported by wheel means, said second figure toy is in the form of a rider removably mounted on the horse, and said dismounting means includes cam means engageable with one foot of the rider for biasing the rider off of the horse, wherein said dismounting means comprises a simulated fence mounted in a fixed position on said frame and said cam means includes a rail thereon having an inclined cam rail portion engageable with the foot of the rider.

5. The accessory of claim 4 wherein said inclined ramp is enclosed within a housing and undulated generally in a vertical direction to cause up and down movement of the horse and mounted rider relative to said housing as they move down the ramp in a galloping fashion.

6. An accessory for use with a travelling toy, such as a model train, or the like, comprising:

a frame having an inclined vertically undulated ramp portion defining a path of travel;

a first figure toy in the form of a horse supportable by wheel means thereon for movement along said path of travel from the top toward the bottom of the inclined undulated ramp;

a second figure toy in the form of a rider removably mountable upon said first figure toy;

dismounting means on the frame at a stationary position along said inclined undulated ramp for engaging the rider figure toy as the horse passes the dismounting means whereby placement of the accessory adjacent the path of travel of the travelling toy permits a user to start the movement of the horse figure toy and mounted rider figure toy to travel down the inclined undulated ramp in a timed relationship so that the dismounting means causes the rider figure toy to alight from the horse figure toy onto the passing travelling toy; and release means at the top of said inclined undulated ramp for engaging the horse figure toy to initiate movement therof from a starting position down the inclined undulated ramp, wherein said release means comprises a generally L-shaped lever having a bottom arm portion engageable with the horse figure toy and a generally vertically oriented crank portion for manual manipulation by a user, the L-shaped lever being pivoted to said frame at the juncture of said arm portion and said crank portion.

* * * * *

UNITED STATES PATENT AND TRADEMARK OFFICE

CERTIFICATE OF CORRECTION

PATENT NO. : 4,020,588

DATED : May 3rd, 1977

INVENTOR(S) : GORDON A. BARLOW et al

It is certified that error appears in the above-identified patent and that said Letters Patent are hereby corrected as shown below:

Col. 1, line 60, after "respective", delete "portions" and insert therefor --positions--.

Column 2, line 8, the numeral "2" should be --12--; line 33, after "support" insert --posts--; line 48, after "downwardly" delete "foot" and insert therefor --in--; line 53, after "plate" the numeral "2" should be --52--; line 59, after "horse" the numeral "13" should be --14--; line 64, after "thereof" insert --of--.

Column 3, line 24, after "horse" the numeral "4" should be --14--.

Claim 1, line 54, after "rider" insert --figure--.
Claim 2, lines 24 and 25, "includng" should be --including--.
Claim 3, line 44, after "in" delete "the inclined" and insert therefor --in a--.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*